US005210915A

United States Patent [19]

Clarke

[11] Patent Number: 5,210,915

[45] Date of Patent: May 18, 1993

[54] SEAT BELT BUCKLE

[75] Inventor: Ron Clarke, Dundonald, Ireland

[73] Assignee: European Components Corporation, United Kingdom

[21] Appl. No.: 954,535

[22] Filed: Sep. 29, 1992

Related U.S. Application Data

[63] Continuation-in-part of Ser. No. 687,890, Sep. 3, 1991, abandoned.

[30] Foreign Application Priority Data

Nov. 6, 1989 [GB] United Kingdom ..... 8925036
Nov. 2, 1990 [WO] PCT Int'l Appl. ..... PCT/GB90/01681

[51] Int. Cl.[5] ..... A44B 11/26
[52] U.S. Cl. ..... 24/641
[58] Field of Search ..... 24/633, 641, 637, 645

[56] References Cited

U.S. PATENT DOCUMENTS 4,064,603 12/1977 Romanzi, Jr. .
4,388,746 6/1983 Krantz et al. .
4,451,958 6/1984 Robben et al. ..... 24/641 X
4,550,474 11/1985 Doty et al. .
4,899,424 2/1990 Barnes et al. ..... 24/641
4,928,366 5/1990 Ballet ..... 24/641

FOREIGN PATENT DOCUMENTS 114332 8/1984 European Pat. Off. .
2010955 7/1979 United Kingdom .
1580726 12/1980 United Kingdom .

*Primary Examiner*—James R. Brittain
*Attorney, Agent, or Firm*—Lyon & Delevie

[57] ABSTRACT

A seat belt buckle adapted to releasably engage a latch plate 42 having an aperture 40 therein, the buckle comprising a rigid frame 10 including a base 12 having an opening therein, upstanding side walls 14 adapted to guide the latch plate longitudinally of the frame, a bar 16 extending transversely of the frame between the side walls, the bar being spaced above the base, a locking member 24 pivotally mounted on the frame and pivotal between a lower latched position and an upper unlatched position, the locking member carrying a downwardly projecting locking element 38 engageable in the aperture 40 in the latch plate 42 to retain the latch plate in place and passing into the opening, a slider 44 slidable longitudinally of the locking member between a first position in which it is located under the bar 16, to retain the locking member in the lower latched position and a second position in which it is resiliently engaged against the rear of the bar to retain the locking member in its upper unlatched position, a push button 52 to push the slider from its first position to its second position, a slider spring 48 to urge the slider towards its first position, a pair of wings 30 extending laterally from the locking member and engaging in the side walls to pivotally and resiliently mount the locking member for movement between its upper and lower positions and a pair of arms 34 extending laterally along the member, the pair of arms engaging abutments on the rigid frame to prevent flexing of the wings beyond their elastic limit.

5 Claims, 1 Drawing Sheet

SEAT BELT BUCKLE

BACKGROUND TO THE INVENTION

Cross-reference to Related Applications

The present invention is a continuation-in-part of prior U.S. patent application Ser. No. 07/687890 filed Sep, 3, 1991, abandoned as filed under the Patent Cooperation Treaty with an effective filing date of Nov. 2, 1990 and entitled "Seat Belt Buckle".

1. FIELD OF THE INVENTION

The present invention relates to an improved seat buckle for seat belts in motor vehicles.

2. DESCRIPTION OF THE PRIOR ART

Prior art seat belt buckle assemblies involve a latch plate having an aperture therein, said latch plate being attached to one part of the seat belt itself and a buckle having a rigid frame including a base having an opening therein and upstanding side walls adapted to guide the latch plate longitudinally of the frame. A releasable locking member engages in the aperture in the latch plate and in the opening in the frame to releasably retain the latch plate.

U.S. Pat. No. 4,899,424 discloses a particular form of such a buckle assembly having a bar extending transversely of the frame between said side walls, said bar being spaced above the base, a locking member pivotally mounted on the frame and pivotal between a lower latched position and an upper unlatched position, a downwardly projecting locking element on said locking member engageable in said aperture in the latch plate effective to retain the latch plate in place and passing into said opening, the locking element, in the lower latching position of the locking member, having its forward edge spaced from the rearward edge of said opening by a given distance under normal conditions, a slider slidable longitudinally of the locking member between a first position in which it is located under said bar, to retain the locking member in the lower latched position and a second position in which it is resiliently engaged against the rear of the bar to retain the locking member in its upper unlatched position, a push button positioned to push the slider from its first position to its second position, a slider spring positioned to urge the slider towards its first position, a pair of wings extending laterally from said locking member and engaging in said side walls to pivotally and resiliently mount the locking member for movement between its upper and lower positions, said wings being capable of elastic flexing, upon axial loading of said locking member by said latch plate.

The latch plate can be inserted against the action of the spring loaded ejector and when in the fully inserted position the locking member is pivoted to a lower latching position in which the locking element engages in the aperture in the latch plate. A push button is used to release the locking member which pivots back to an unlatched position.

For a seat belt buckle to operate satisfactorily, it must be capable of being comfortably worn in a latched condition and readily be releasible when the user wishes to leave the vehicle. The user must be protected from vehicle accidents and from secondary accidents by the seat belt. The buckle therefore must not be capable of releasing the latch plate during an accident or as a result of an impact of an accident. For a seat belt to operate satisfactorily, it must be capable of releasing the latch plate from the buckle easily in order that the driver or passenger may get out of the vehicle immediately. This is the purpose of the structure of U.S. Pat. No. 4,899,424. In that patent the condition in which the latch plate latches to the locking bar of the locking element, that is to say the normal wearing condition of the seat belt, is the condition in which the belt can take the load of the driver moving forwardly during an accident situation.

The latch plate takes large loads in a forward direction and the buckle itself takes large loads in the rearward direction, so that the lock bar of the locking member takes the loads in the forward direction imparted by the latch plate and the latch plate is prevented from releasing from the buckle by the forward edge of the lock bar and the forward edge of the base plate aperture contacting and withstanding the large loads.

Now, after an accident has occurred, when the loads are no longer applied, the forward edge of the lock bar remains in contact with the forward edge of the aperture in the base plate. Therefore, the locking member cannot rotate and the latch plate cannot be released readily from the buckle by the occupant or a rescuer.

The pair of wings extend laterally from the locking member and engage in the side walls of the frame to pivotally and resiliently mount the locking member from movement between its upper and lower positions, the wings being capable of flexing. To operate satisfactorily within its own limitations, the buckle of Patent 4899424 makes possible pivoting of the locking member using the flexibility of the wings. However, with this structure the applied loads are taken, not only by both the forward edge, but also by the locking member which tends to rotate downwardly, and in this case the wing portions deform not elastically but plastically and eventually the lock bar of the locking member is then unable to return to the initial position and this can cause a problem of release of the buckle after an accident.

3. SUMMARY OF THE INVENTION

It is an object of the present invention to overcome such problems.

According to the invention, these problems are overcome by providing a pair of arms extending laterally from the locking member, the pair of arms engaging at least in the lower position of the latching member, the abutments on the rigid frame to prevent flexing of the wings beyond their elastic limit and by said pair of arms having their forward edges spaced from their associated abutment by spacing less than the distance by which the forward edge of the locking member is spaced from the rearward edge of the opening under normal conditions, whereby the load bearing capacity of said pair of arms and their associated abutment are enhanced by engagement of the forward edge of the locking member with the rearward edge of the opening.

With such a structure, the clearance between the upper arms and the base plate is designed in order to keep the deformation of the wings within their elastic limit, thereby to enable, even after an accident situation, the buckle to be released. In a preferred construction, the pair of arms extend laterally from the latching member at a location between the wings and said opening and, advantageously, said laterally extending arms are shorter than said laterally extending wings so that the wings can deform elastically more readily than the arms which therefore act as stop members.

In order that the present invention may more readily be understood, the following description is given, merely by way of example, reference being made to the accompanying drawings.

4. BRIEF DESCRIPTION OF THE DRAWINGS

5. DETAILED DESCRIPTION OF THE PREFERRED EMBODIMENT

Figure 1:
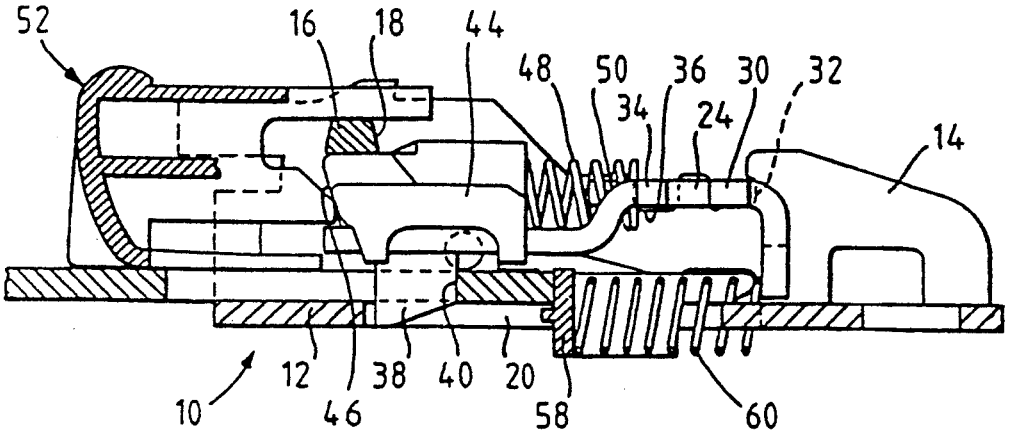
FIG. 1 is a side elevation of one embodiment of buckle according to the invention shown in the latched position.
Figure 2:
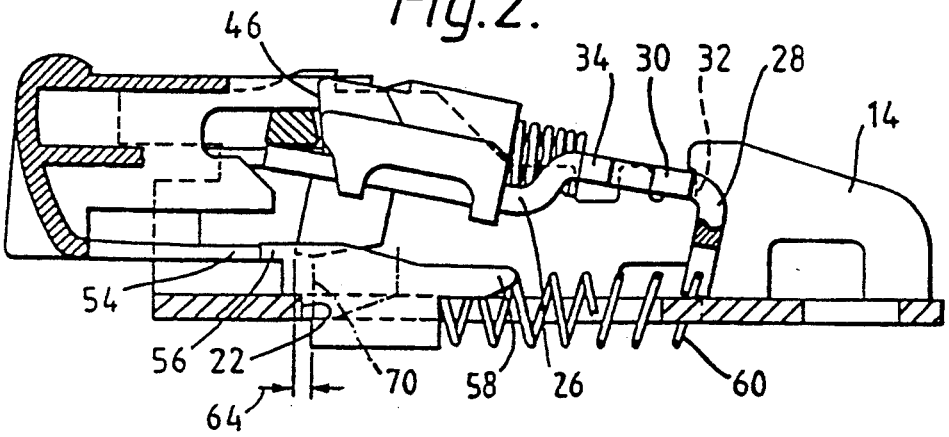
FIG. 2 is a similar view in section in the unlatched position.

Referring first to FIG. 1 the buckle includes a rigid frame 10 having a base plate 12 having two upstanding side walls 14 extending from each side edge thereof A bar 16 extends between the side walls 14 and is spaced from and parallel to the base plate 12. An opening 20 is formed in the base plate 12 and is provided with a front edge 22 (FIG. 2).

Pivotally mounted between the side walls 14 is a locking member 24, which includes a forwardly extending body 26 and downwardly extending legs 28. The body is provided with two laterally extending wings 30 engaging in rear notches 32 in the side walls 14. Extending parallel to these wings 30 are arms 34 which can, in the lower latched position as illustrated in FIG. 1, engage in forward notches 36 in the side wall. The arms 34 are shorter than the wings 30 and are positioned between the wings 30 and the opening 20. The arms 34 are therefore relatively rigid.

At the forward end of the body 26 of the locking member is a locking element 38 which, in the latched position, passes through an aperture 40 in a latch plate 42 to retain the latch plate in place. It will be noted that longitudinally slidable on the locking member 24 is a slider 44 having a chamfered leading edge 46. The slider is urged towards the front (the left in the figures) by a slider spring 48 engaged over a projection 50 on the body 26 of the locking member 24.

Longitudinally slidable on the side walls 14 is a push button 52 which has rearward projections 54 engaging forward projections 56 on an ejector 58 longitudinally slidable in the opening 20 in the base plate 12, and urged to the forward position by an ejector spring 60.

In use, starting from the position illustrated in FIG. 2, a latch plate 42 is inserted in the guide channel formed by the base plate 12 and the side walls 14, it causes the ejector 58 to move rearwardly, that is to the right, against the action of its spring 60. This movement continues until the ejector is moved so far rearwards that it engages on the bottom of the leg 28 of the locking member 24. The resulting couple rotates the locking member/slider system causing the slider 44 to move down and return under the bar 16 to the position illustrated in FIG. 1. When the plate 42 is unloaded, the aperture 40 therein abuts the locking element 38 which retains the latch plate 42 in place so that the buckle cannot unlatch.

In this condition, if an accident or the like occurs, and a very great strain is put on the buckle, then the latch plate 42 will be urged forward and will move with it the locking element 38, thereby closing the gap 64 illustrated in FIG. 2, so that the front face of the locking element 38 abuts the front face 22 of the aperture 20. During this movement, the wings 30 will flex rearwards but the relatively rigid arms 34 engaging the front of the notches 36 will act as stops to prevent anything more than a limited flexing so that the wings are not stressed beyond their elastic limit and there is no plastic deformation. This means that the buckle can be unlatched by the vehicle occupant or by a rescuer.

Figure 3:
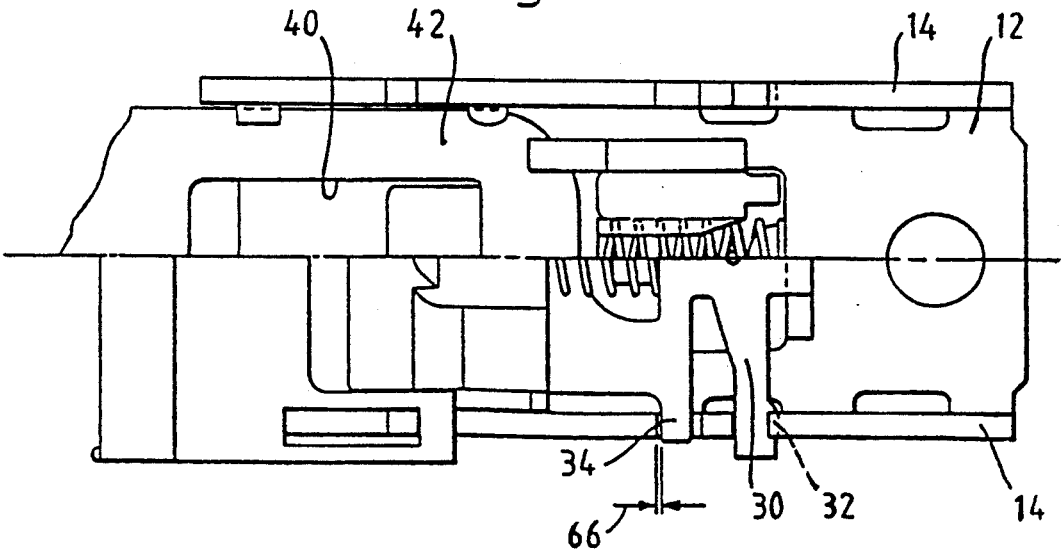
FIG. 3 is a plan view, half in section, of the buckle illustrated in FIGS. 1 and 2.

With the reduction of load (after impact) both the wings and the main body of the locking member recover elastically to restore the clearances 64,66 (FIG. 3) between the locking member 34 and the frame sufficient to allow the front face 70 of the locking element 38 to sweep past the frame edge 22, when the locking member is released to the unlatched position and in particular with the release preformed whilst specific test loads are being applied longitudinally through the latch plate.

I claim;

1. In a seat belt buckle adapted to releasably engage a latch plate having an aperture therein, said buckle comprising a rigid frame including a base having an opening therein, upstanding side walls adapted to guide the latch plate longitudinally of the frame, upper edges of said side walls, a bar extending transversely of the frame between said side walls, said bar being spaced above the base, a locking member pivotally mounted on the frame and pivotal between a lower latched position and an upper unlatched position, a downwardly projecting locking element on said locking member engageable in said opening in the latch plate effective to retain the latch plate in place and passing into said opening, the locking element, in the lower latching position of the locking member, having its forward edge spaced from the rearward edge of said opening by a given distance under normal conditions, a slider slidable longitudinally of the locking member between a first position in which it is located under said bar, to retain the locking member in the lower latched position and a second position in which it is resiliently engaged against the rear of the bar to retain the locking member in its upper unlatched position, a push button positioned to push the slider from its first position to its second position, a slider spring positioned to urge the slider towards its first position and, a pair of wings extending laterally from said locking member and engaging in said side walls to pivotally and resiliently mount the locking member for movement between its upper and lower positions said wings being capable of elastic flexing, upon axial loading of said locking member by said latch plate, the improvement consisting of abutments on said rigid frame, and a pair of arms extending laterally from said member, said a pair of arms engaging, at least in the lower position of the latching member, said abutments on said rigid frame to prevent flexing of said wings beyond their elastic limit, and said pair of arms having their forward edges spaced from their associated abutment by a spacing less than said given distance, whereby the load bearing capacity of said pair of arms and their associated abutment are enhanced by engagement of the forward edge of the locking element with the rearward edge of the opening.

2. A buckle according to claim 1, wherein said pair of arms extend laterally from said latching member at a location between said wings and said opening.

3. A buckle according to claim 1, wherein said laterally extending arms are shorter than said laterally extending wings.

4. A buckle according to claim 3, wherein said abutments are in a form of notches in the upper edges of said side walls.

5. A buckle according to claim 1, wherein the rearward edge of said bar and the forward edge of said slider are cooperatingly chamfered to retain the locking member in its upper unlatched position when said forward and rearward edges are inter-engaged by said slider spring.

* * * * *